US007635214B2

(12) United States Patent
Perlo

(10) Patent No.: US 7,635,214 B2
(45) Date of Patent: Dec. 22, 2009

(54) MODULAR SYSTEM FOR LUMINOUS SIGNALS, PARTICULARLY FOR ROAD SIGNALS

(75) Inventor: Piero Perlo, Sommariva Bosco (IT)

(73) Assignee: C.R.F. Società Consortile per Azioni, Orbassano (Turin) (IT)

( * ) Notice: Subject to any disclaimer, the term of this patent is extended or adjusted under 35 U.S.C. 154(b) by 170 days.

(21) Appl. No.: 11/683,166

(22) Filed: Mar. 7, 2007

(65) Prior Publication Data

US 2007/0209254 A1 Sep. 13, 2007

(30) Foreign Application Priority Data

Mar. 8, 2006 (EP) ..... 06425156

(51) Int. Cl.
*F21V 5/00* (2006.01)
*G09F 13/18* (2006.01)

(52) U.S. Cl. ..... 362/559; 362/551

(58) Field of Classification Search ..... 362/812, 362/183, 555, 559, 576, 26, 551; 40/541, 40/547, 546, 612
See application file for complete search history.

(56) References Cited

U.S. PATENT DOCUMENTS

| | | | | |
|---|---|---|---|---|
| 6,079,839 | A | 6/2000 | Leibe | |
| 6,092,318 | A * | 7/2000 | Arie et al. | 40/547 |
| 6,160,948 | A * | 12/2000 | McGaffigan | 385/146 |
| 6,601,984 | B2 * | 8/2003 | Yamamoto et al. | 362/600 |
| 7,021,809 | B2 * | 4/2006 | Iwasa et al. | 362/555 |
| 2002/0159245 | A1 * | 10/2002 | Murasko et al. | 362/84 |
| 2003/0067789 | A1 | 4/2003 | Velez | |

FOREIGN PATENT DOCUMENTS

| | | | |
|---|---|---|---|
| DE | 19632699 | A1 | 2/1998 |
| EP | 0341817 | A1 | 11/1989 |
| EP | 0874191 | A2 | 10/1998 |
| JP | 2002069946 | | 8/2002 |
| WO | WO0118776 | A2 | 3/2001 |

OTHER PUBLICATIONS

EP Search Report dated Jun. 7, 2006, for European Application No. 06425156.4.

* cited by examiner

*Primary Examiner*—Jacob Y Choi
(74) *Attorney, Agent, or Firm*—Heslin Rothenberg Farley & Mesiti P.C.; Victor A. Cardona, Esq.

(57) ABSTRACT

A modular system for illuminated signs, in particular for road signs, includes a plurality of bars that can be put together so as to form a frame structure. Each bar has a full body made of a material usable as light-guide, for example polycarbonate, substantially transparent to the color of the light that propagates inside it, in which a LED light source is integrated. The system moreover comprises a plurality of modules in the form of letters, figures or symbols, which can be positioned within the aforesaid frame and are each also constituted by a body of material usable as light-guide, for example polycarbonate, substantially transparent to the color of the light that propagates inside it, with at least one LED light source integrated within each module. Each of the aforesaid modules is provided with at least one pair of terminals for connection of the respective LED source with a source of electrical supply.

16 Claims, 6 Drawing Sheets

MODULAR SYSTEM FOR LUMINOUS SIGNALS, PARTICULARLY FOR ROAD SIGNALS

CROSS REFERENCE TO RELATED APPLICATIONS

This application claims priority from European patent application No. EP06425156.4, filed on Mar. 8, 2006, the entire disclosure of which is incorporated herein by reference.

BACKGROUND OF THE INVENTION

The present invention relates to the field of illuminated signs, particularly, even though not exclusively, for road signs.

SUMMARY OF THE INVENTION

The purpose of the invention is to propose a new system of illuminated signs that will present characteristics of constructional simplicity, low energy consumption, whilst at the same time affording the possibility of making signs even of very large dimensions, and finally with high visibility both in daylight and at night.

According to the invention, a modular system for illuminated signs is proposed, comprising a supporting structure and a plurality of modules arranged on said supporting structure, in the form of letters, figures or symbols in general, each of said modules being made up of a body made of a material that can be used as light-guide, which is substantially transparent, with at least one LED light source set within said body, and at least one pair of connection terminals for connection of the LED source to a source of supply.

In the preferred embodiment, the supporting structure includes a plurality of bars that can be put together in such a way as to form a frame structure, in which each bar is constituted by a body made of a material usable as light-guide substantially transparent to the colour of the light that propagates inside it, with at least one LED light source set within the body, and at least one pair of connection terminals for connection of the LED source to the source of supply, said modules being positioned within the aforesaid frame.

According to a further characteristic, a coloured diffusing layer is deposited on one of the sides of the body of the modules of the frame and of the symbol modules. The system described above thus enables wordings, indications or successions of symbols of any type to be composed so as to form a set of bodies, as if suspended in the air within the aforesaid modular frame structure. Said bodies and the frame appear with the colour defined by the diffusing layer deposited on one of the sides thereof, for example white, or else red or else blue, etc. At night or in poor lighting conditions, the system is illuminated by supplying electric current to the LED source set within each module (frame bar, or letter, or symbol) of the system. The use of a LED source, in combination with a light-guide body, enables illumination of even very large bodies to be obtained, with a low energy consumption. The system of signs according to the invention is hence visible also at a great distance, and appears as a succession of letters or symbols of any colour obtained with one or more LEDs, within a frame that is also coloured, against the dark background. In daylight, the symbols and the letters, as well as the frame, are in any case visible clearly thanks to their colour and to their relatively large dimensions. Preferably, moreover, the symbols or the letters are in turn outlined by a border preferably silk-screen printed on the letter or symbol of a colour chosen to contrast with the colour of the symbol or letter.

In a preferred embodiment, the supply source is constituted by one or more batteries of any known type, preferably associated to a power-generator system, for example a photovoltaic panel, or else a lens and a thermoelectric generator or a single wind-power generator or one of the matrix type.

BRIEF DESCRIPTION OF THE DRAWINGS

Further characteristics and advantages of the invention will emerge from the ensuing description with reference to the annexed plate of drawings, which are provided purely by way of non-limiting example and in which.

DETAILED DESCRIPTION OF THE INVENTION

Figure 1:
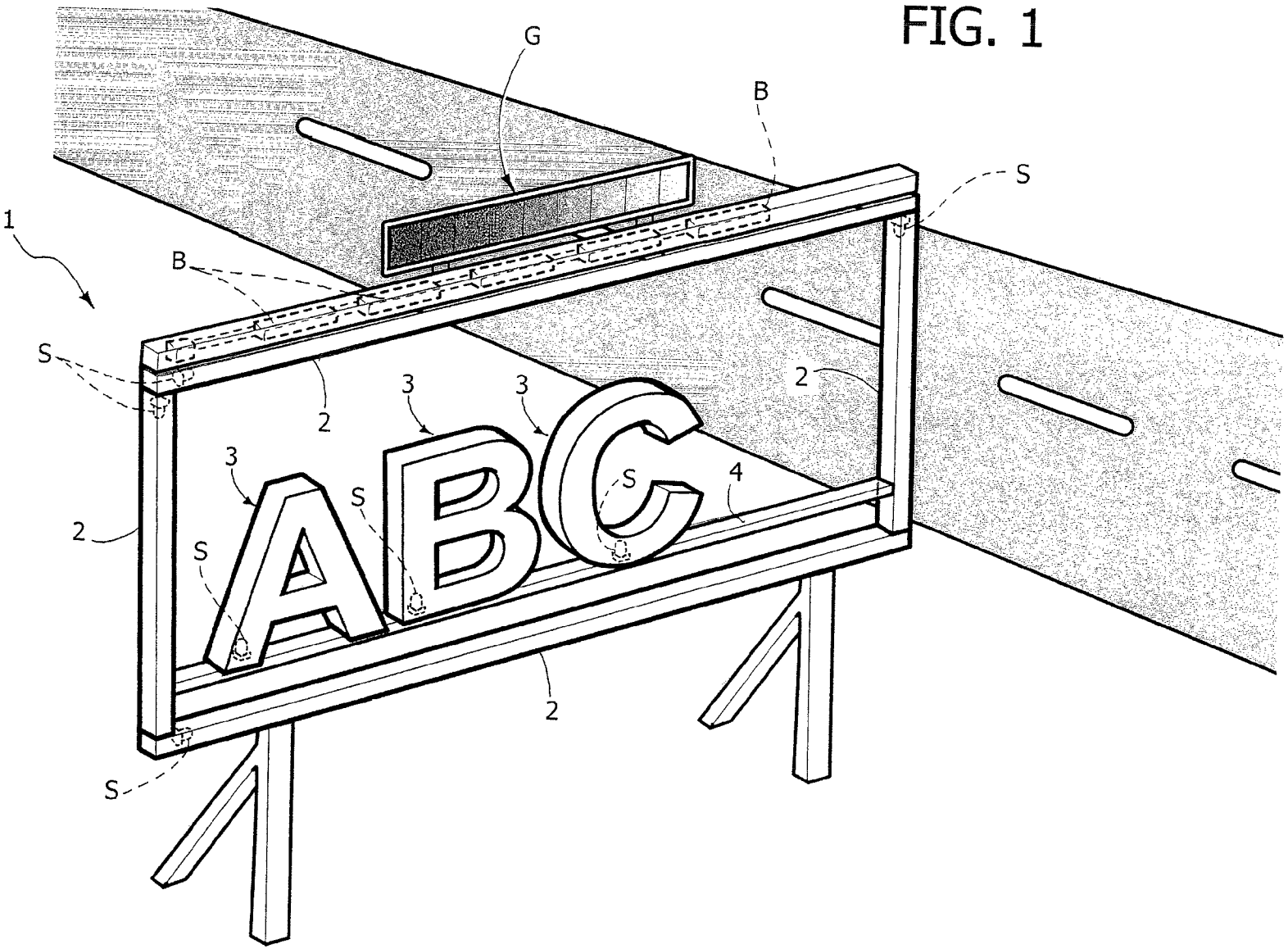
FIG. 1 is a schematic perspective view of a road-sign panel obtained with the system according to the invention.

FIG. 1 shows an example of embodiment of a panel for road signs using the system according to the invention. The panel, designated as a whole by the reference number 1, comprises a plurality of modules 2 in the form of bars that can be connected mechanically and electrically to one another, in a fast way, using means that will be illustrated in what follows. The bars 2 constitute the sides of a frame, within which the wording or, in general, the succession of symbols that forms the subject of the signal is composed. In the example illustrated, modules 3 are provided in the form of letters, supported on a bar 4, which can in turn be of a type similar to the bars 2, or be simply constituted by a supporting element that has the purpose of strengthening also the overall structure, which extends horizontally or vertically or diagonally between the two vertical bars 2, within the frame.

Each of the modules 2 and each of the modules 3 is preferably made up of a full body made of a material usable as light-guide, for example polycarbonate, substantially transparent to the colour of the light that propagates within it. For example, the module 3 may also be made of red-coloured methacrylate illuminated laterally by red LEDs. The light-guide could be made in a tubular form, and in this case the propagation of the light inside it or on the border thereof may be favoured by prismatic grooves. Integrated within said body, at one or both of its ends, or also at the centre are one or more LED sources of any known type, designated by S in the plate of drawings.

Figure 3:
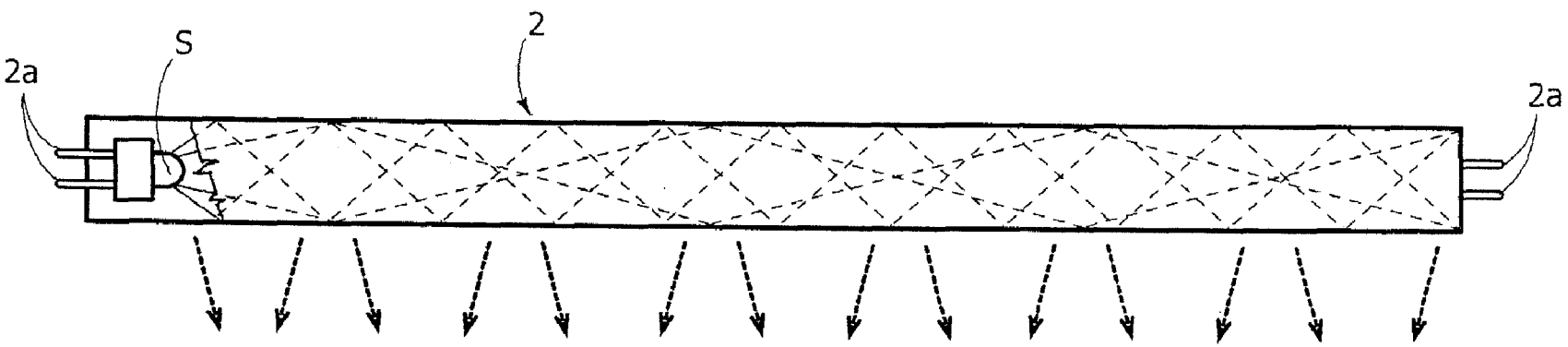
FIG. 3 is a schematic side view of the module of FIG. 2.

When the LED source S is lit up, the rays of light emitted thereby propagate along each module 2 and 3 and come out thereof (see FIG. 3).

Deposited on the side opposite to the one on which the light comes out is a diffusing coating, for example white with a base of titanium dioxide, or in general a coloured diffusing coating. The light that propagates in the guide is gradually and uniformly scattered by the diffusing coating so that a part thereof comes out of the guide.

In order to orient better the direction of the beam of light leaving the guide, matrix micro-optics may be arranged thereon, or more simply the side of the guide with the diffusing layer may be provided with a curvature.

The side walls of the letters or of the symbols may also be coated with a diffuser.

In certain types of letters, and in particular for the frame, the diffuser may be deposited by coating just one part of the letter, in this case enabling the letter and/or frame to be visible at a distance even from behind.

Figure 2:
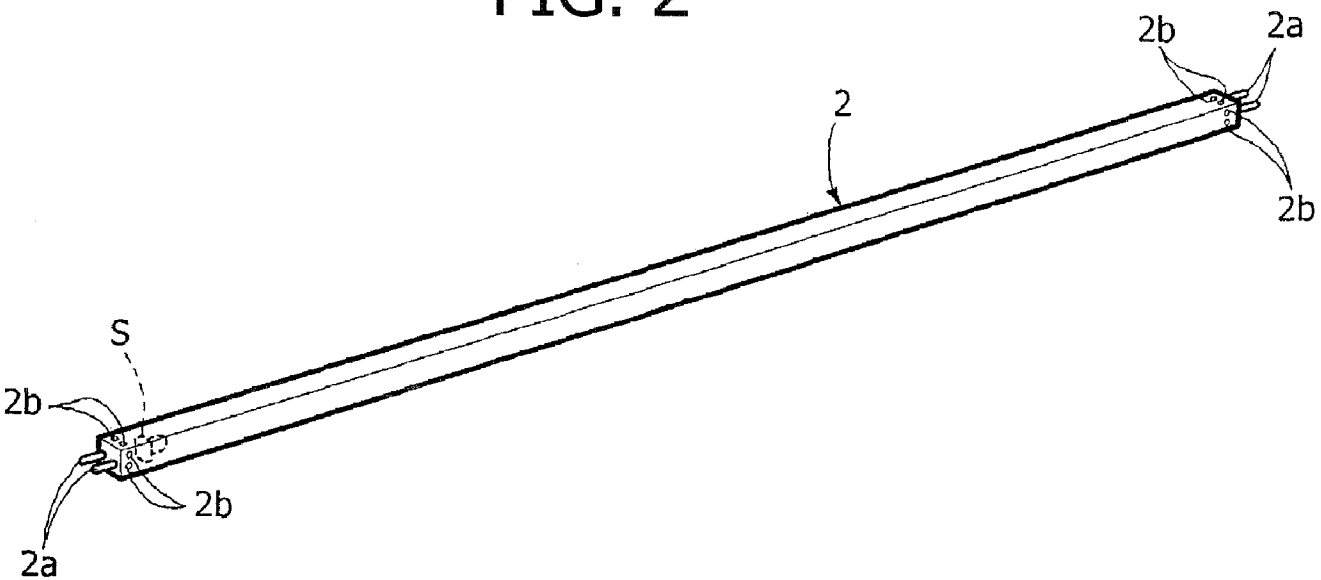
FIG. 2 is a perspective view of a module forming part of the system of FIG. 1.

FIG. 2 shows a preferred embodiment of a bar module 2, in which provided at each end are two axial terminals 2*a*, which serve both as electrical connection of the respective LED source S to a source of electrical supply and as mechanical connection to the adjacent bars 2. For this purpose, each bar 2 is also equipped with female connection terminals 2*b* at the end of each of its side faces. In this way, the male terminals 2*a* of each bar can be received within a pair of female terminals 2*b* of an adjacent bar so as to make the electrical connection with the source of supply and at the same time the mechanical connection between the various modules. A similar system is usable for mechanical and electrical connection of each module 3 to the supporting bar 4, which in turn can be equipped at its ends with means for electrical connection to the supply source.

In the example illustrated, the source of electrical supply is constituted by one or more batteries B of any known type, preferably associated to a power generator G, for example in the form of a photovoltaic panel (as illustrated in FIG. 1) or in the form of a wind-power generator or again in the form of a lens that focuses on a thermoelectric module or a piezoelectric film, which, by bending or by vibration, produces electricity.

Figure 7:
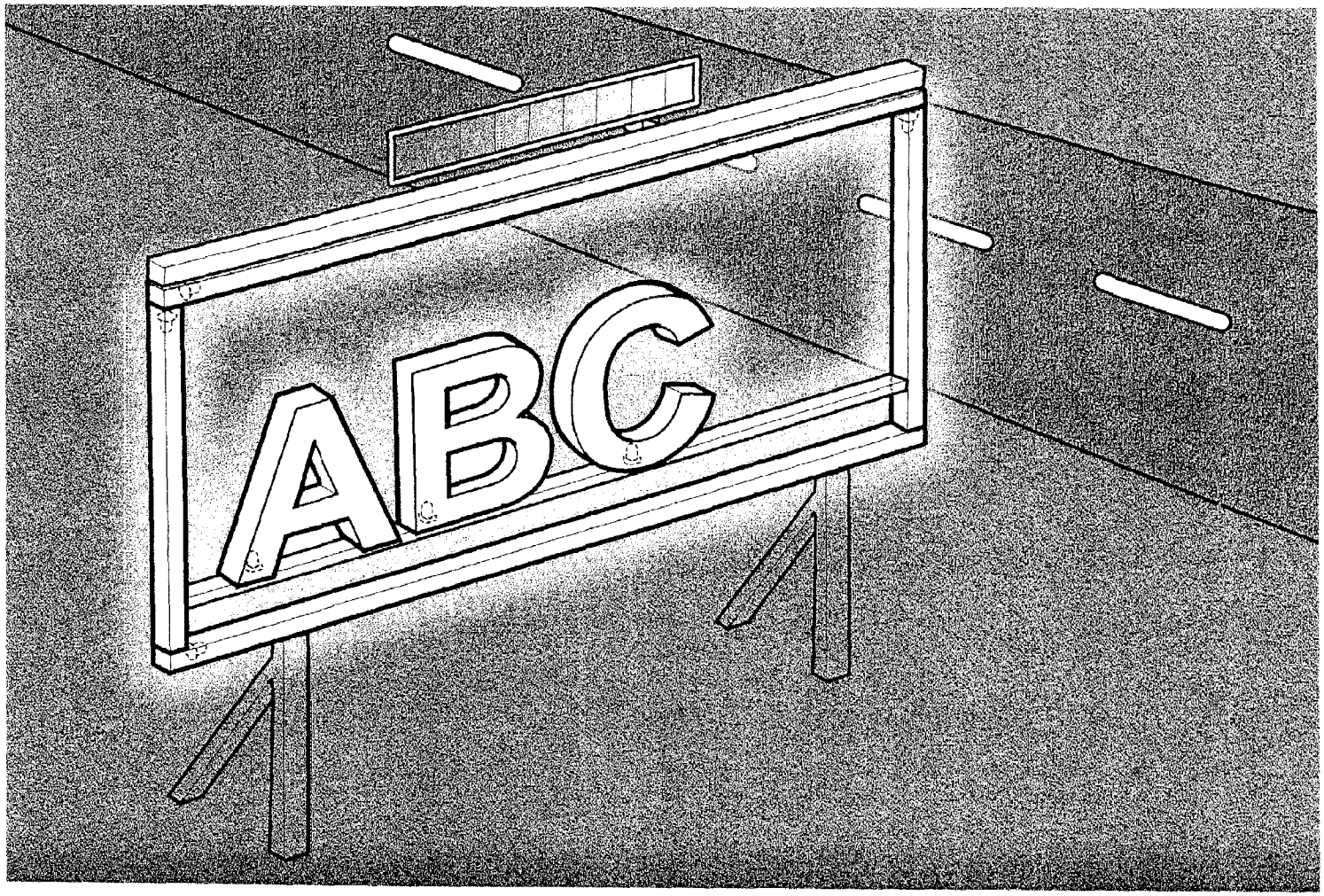
FIG. 7 illustrates the panel of FIG. 1 in the lit-up condition, at night.

As may be seen in FIG. 1, the set of the letters or symbols forming the sign appears as if suspended in the air within the frame. At night, the bars 2 forming the frame and the modules 3 forming the sign are lit up, as illustrated in FIG. 7, so as to constitute a set of coloured bodies against the dark background. The use of LED sources in association with light-guides of the type described above enables a low energy consumption, even with luminous bodies of very large dimensions, which renders the system according to the invention particularly suited to being used for road signs visible also from a great distance.

Figure 4:
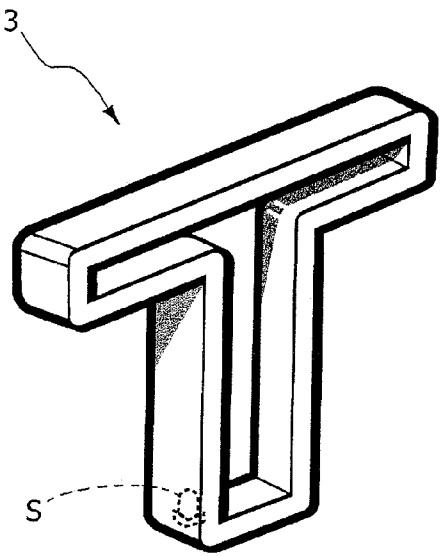
FIG. 4 illustrates a variant embodiment of a letter module of the system according to the invention.

FIG. 4 shows a variant embodiment of a letter module 3, in which the body of the module constitutes just an outline defining the letter or the symbol.

Figure 5:
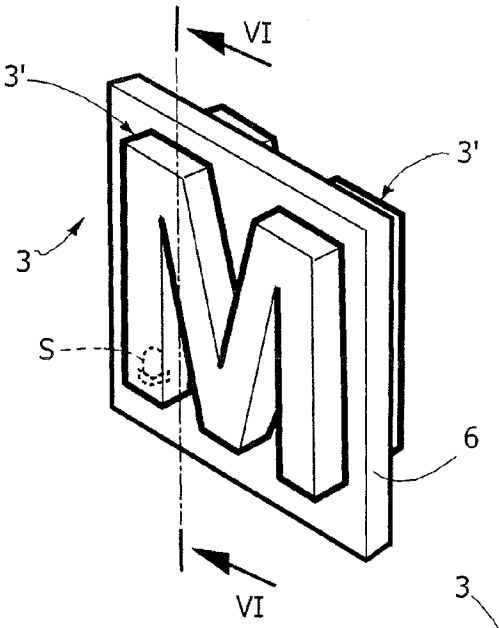
FIG. 5 illustrates a further variant.
Figure 6:
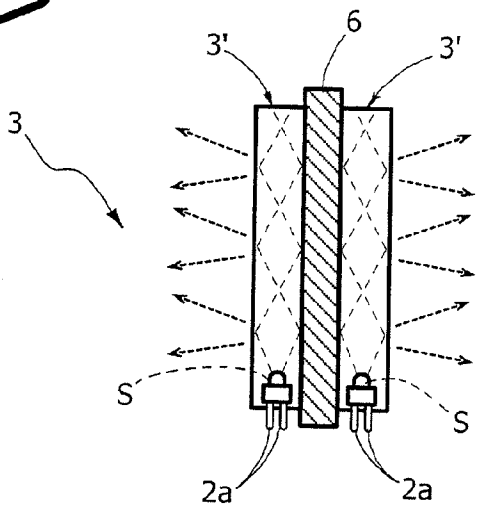
FIG. 6 illustrates a cross section according to the line VI-VI of FIG. 5.
Figure 8:
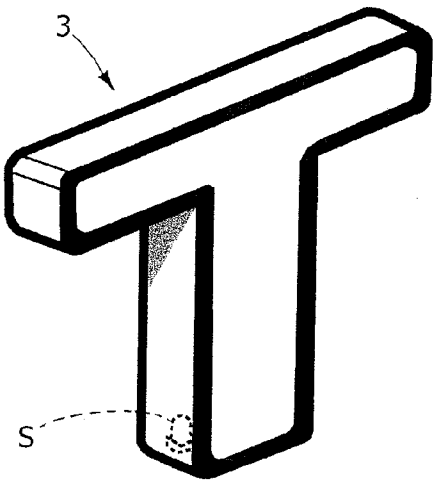
FIG. 8 illustrates a light-coloured letter, for example white or red with a dark outline, for example blue or black, designed to contrast in daylight with the colour of the letter.

FIGS. 5 and 6 illustrate a further variant, which may be used in the case where it is intended to make a sign that is visible on both of its faces. In this case, each module 3 comprises an opaque panel 6, which bears, on the two opposite faces two modules 3' obtained, according to the present invention, as bodies made of light-guide material englobing respective LED sources S. The opaque panel may be set also on the letters indicated in FIG. 4 or any other letter or symbol, and in this case the panel may be provided with small holes that reduce the area of exposure to the wind.

The solar panels, in addition to being exposed to sunlight, may also be adjacent to the border both on the outer side and on the inner side and in particular may be of a flexible-film type, which operates with high efficiency also on scattered sunlight (albedo).

The converters of sunlight may be chosen from among the various types derived from monocrystalline silicon, multicrystalline silicon, string ribbon, thin film such as amorphous silicon, cadmium tellurate, copper-indium-diselenide or dye-sensitized electrochemical junction (Graetzel cell), polymeric photovoltaic, or photosynthetic photovoltaic.

The rechargeable batteries may be chosen without any restriction, for example from among the families of Ni—Cd, Ni-MH, Li-ion, Li-Pol, or again from among planarizable or film types of batteries.

A lighting sensor, set on the frame and connected to a purposely provided electrical circuit, controls turning-on and turning-off of the LEDs.

A purposely provided sensor, for example of a multi-cell type or of a microcamera type may be provided for detecting the visibility and, according to the signal detected, controlling, by means of an electrical circuit, the intensity of the LEDs. In the case of fog or in general of reduced visibility, the intensity will be maximum.

In a possible application, the frame, or a symbol, or any letter may be supplied in a pulsed form in order to highlight better, for example, the dangerousness of a bend or of a crossroads.

In the case of indicating arrows, the supply of the LEDs may be given in sequence according to times and modalities that can be regulated easily via a processor for control of the entire panel.

The optics of the letters or of the frame or of the symbols will be equipped with opaque or reflecting coating on the side that faces upwards in order to nullify the luminance beyond the horizon. The introduction of simple shieldings may further reduce the luminance for small angles below the horizon.

As emerges clearly from the foregoing description, the system according to the invention presents important advantages from the standpoints of constructional simplicity, ease of installation and flexibility of use, in terms of possibility of composing different signs starting from the same modules, together with the possibility of making signs of even very large dimensions, with low energy consumption.

Figure 9:
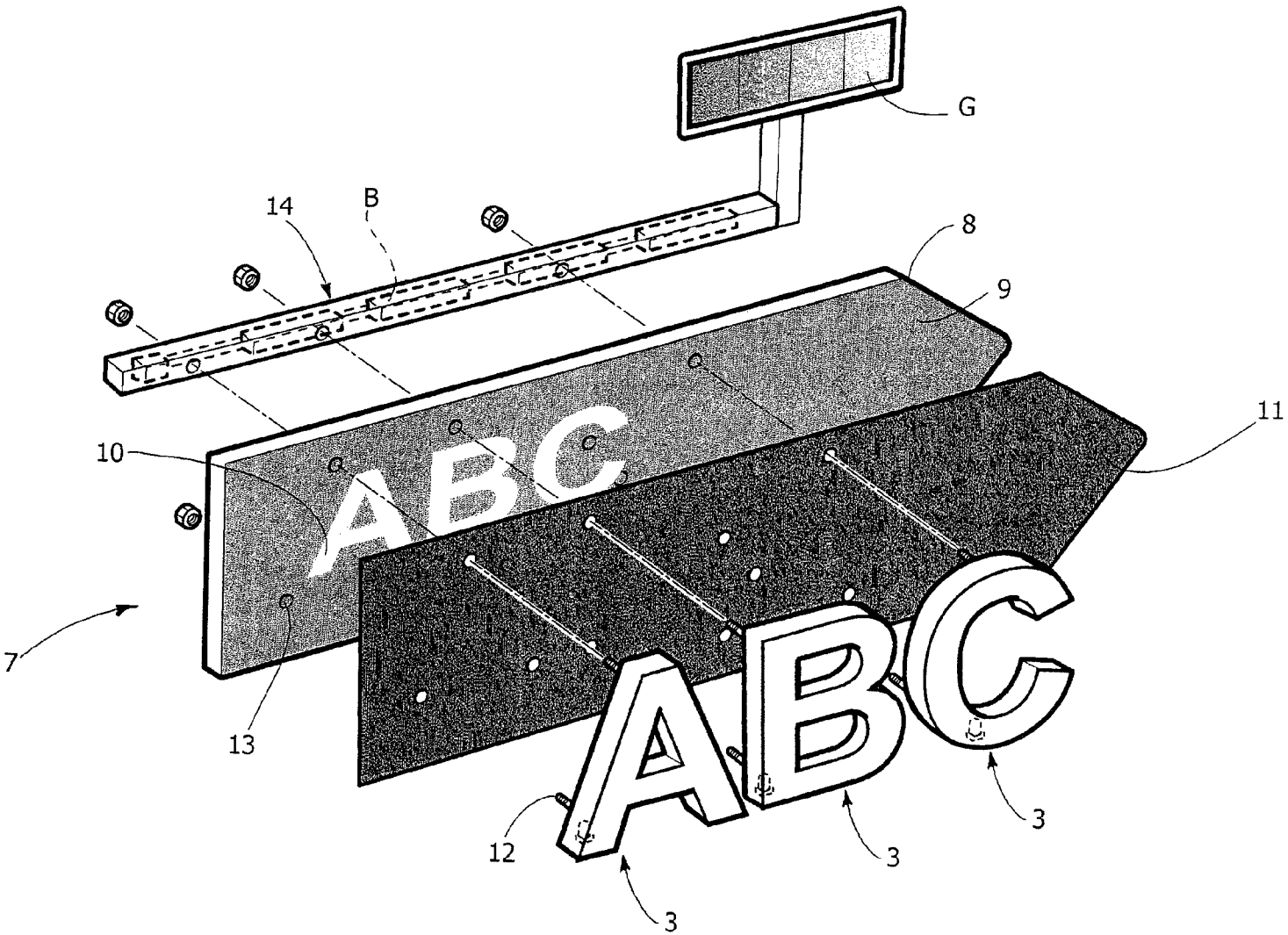
FIGS. 9 and 10 illustrates an exploded perspective view and an assembled perspective view of a road sign according to the invention, obtained starting from a conventional road sign.
Figure 10:
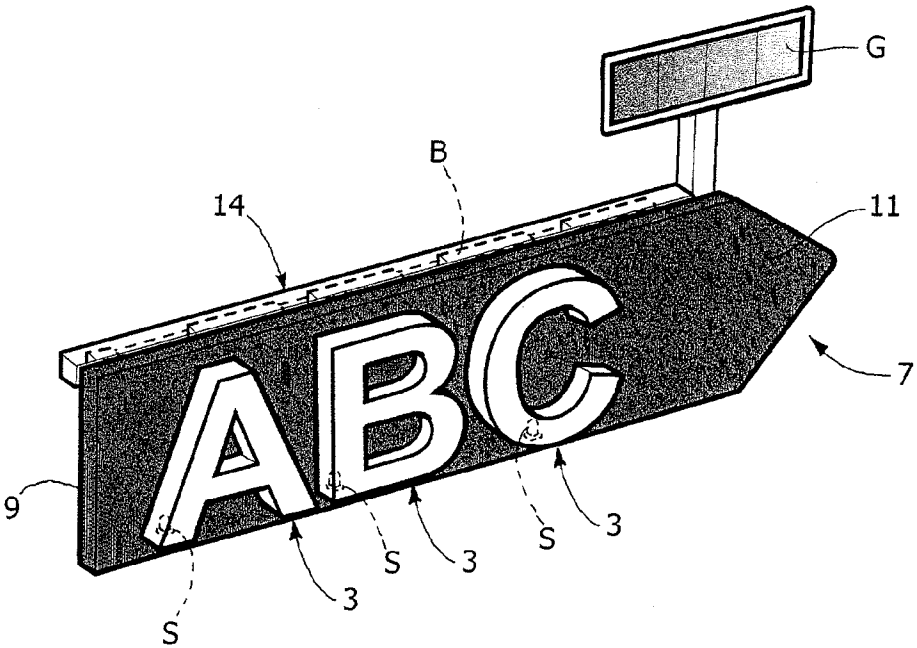

FIGS. 9 and 10 refer to an embodiment of the invention obtained by means of transformation of a conventional road sign. In said figures, the number 7 designates a road sign of a conventional type, comprising a panel 8 with a front surface 9 bearing wordings or symbols 10. In this case, the road sign 7 is used as supporting structure. Preferably, glued on the front surface 9 is a sheet of plastic material 11, for example of a dark colour, and in any case such as to cover the colour of the background and/or of the original wordings on the surface 9. Above the sheet 9 are fixed a number of modules 3 of the type that has been described previously, which can be obtained with one or more of the solutions also described previously (diffusing layer and/or outline, etc.). The modules 3 are preferably of dimensions larger than those of the original wording or symbol, to improve visibility from a distance.

Preferably integrated in the modules 3 are fixing screws 12 designed to engage holes 13 made in the panel 8. Fixed behind the panel 8, using the same screws, is a supporting structure 14 for the batteries B and for the generator G.

Figure 11:
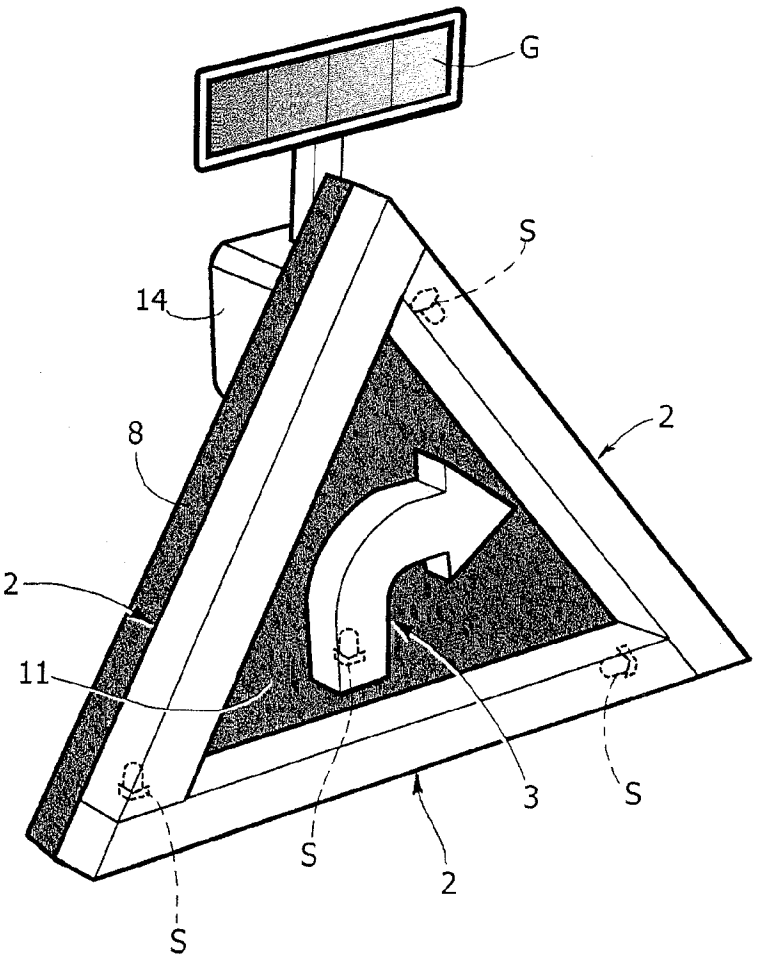
FIG. 11 illustrates a variant of FIG. 10.

FIG. 11 illustrates a similar solution applied to the transformation of a road sign, in the case in point a sign indicating a dangerous bend. In this case, applied above the original panel is the layer 11, and then both a module 3 according to the invention representing the symbol of the bend and modules 2 according to the invention, in the form of bars, designed to represent the perimetral band of the road sign.

Also in the case of FIGS. 9-11, the advantages of the invention are evident in terms of possibility of transforming, with simple and inexpensive means, conventional road signs and signals into illuminated signs visible from a great distance and easily controllable according to various operating modalities (continuous or pulsed lighting) to obtain a high effectiveness and safety of warning.

According to a further preferred characteristic, the modules 2, 3 of the modular system according to the invention are provided with a self-cleaning coating layer, for example of any known type used on plates of glass.

Of course, without prejudice the principle of the invention, the details of construction and the embodiments may vary widely with respect to what is described and illustrated herein by way of example, without thereby departing from the scope of the present invention.

What is claimed is:

1. A modular illuminated sign system comprising:

a plurality of bars connected to each other to form a supporting structure, each bar comprising a bar body forming a light-guide such that said bar body is substantially transparent and at least one LED light source set within said bar body, each bar comprising connecting terminals electrically and mechanically connecting each bar to an adjacent bar of the plurality of bars;

a plurality of modules connected to, and located within a perimeter formed by, said supporting structure, each module comprising a module body forming a light-guide such that said module body is substantially transparent, with at least one LED light source set within said module body and at least one pair of terminals for electrical connection of the LED light source to the source of electrical supply; and each module monolithically forming at least one of a letter, number and symbol, each module mechanically and electrically connected to said supporting structure.

2. The modular system according to claim 1, wherein the plurality of said bars and said plurality of modules is made of at least one of polycarbonate and polymeric material transparent to the colour of the source used and reinforced with additives according to known procedures to be resistant to yellowing caused by sunlight.

3. The modular system according to claim 2, wherein each bar has a pair of male terminals projecting axially from each end, said terminals configured for electrical connection of an LED source set within the bar with the electrical source and for mechanical connection of the bar to an adjacent bar.

4. The modular system according to claim 3, wherein each bar has at least one side surface, said at least one side surface having two female terminals at ends thereof, said has-two female terminals configured for electrical and mechanical connection to two male terminals of an adjacent bar.

5. The modular system according to claim 1, wherein each module of said plurality of modules has a body defining an outline of the letter or symbol designed to improve the visibility of the said letter or symbol.

6. The modular system according to claim 1, wherein each of said modules has an opaque panel having on two modules visible from opposite sides of the sign system on two opposite faces of said panel.

7. The modular system according to claim 1, wherein the modules are supported by a supporting bar extending horizontally vertically or diagonally in the space internal to the aforesaid frame, between two vertical bars forming the frame.

8. The modular system according to claim 7, wherein said supporting bar comprises a bar of said plurality of bars.

9. The modular system according to claim 1, wherein said source of electrical supply comprises one or more batteries.

10. The modular system according to claim 9, wherein said battery is of the rechargeable type and is associated to a power generator.

11. The modular system according to claim 10, wherein said generator is made up of one or more photovoltaic solar panels.

12. The modular system according to claim 1, wherein the supporting structure includes a road sign of a conventional type, comprising a panel with a front surface bearing wordings or symbols in general, and in that said modules in the form of letters or symbols with light-guide body and at least one LED integrated therein are fixed on the front surface of the road sign, so as to cover the original wordings or symbols.

13. The modular system according to claim 12, wherein said modules are fixed on said front surface with the interposition of a layer of coating material, of a colour contrasting with that of the modules.

14. The modular system according to claim 13, wherein the letters or symbols of the modules are of dimensions larger than those of the original road sign.

15. The modular system according to claim 12, wherein fixed behind the panel is a supporting structure for the batteries and for the generator.

16. The modular system according to claim 1, wherein said supporting structure further comprises a spacer member which is non-lightable, said spacer member located between, and connected to, a connecting bar of the plurality of bars and said plurality of modules, such that a non-lit space appears between the plurality of modules and the connecting bar when the plurality of modules and the connecting bar are lighted.

* * * * *